United States Patent [19]

Lomax

[11] Patent Number: 4,535,312

[45] Date of Patent: Aug. 13, 1985

[54] ELECTRICAL CONTACT UNITS

[75] Inventor: Ronald W. Lomax, Harlow, England

[73] Assignee: International Standard Electric Corporation, New York, N.Y.

[21] Appl. No.: 530,182

[22] Filed: Sep. 8, 1983

[30] Foreign Application Priority Data

Sep. 8, 1982 [GB] United Kingdom ..... 8225565

[51] Int. Cl.[3] ..... H01H 1/54

[52] U.S. Cl. ..... 335/196; 335/229; 335/131; 200/278

[58] Field of Search ..... 335/78, 229, 279, 196; 200/278; 361/288

[56] References Cited

U.S. PATENT DOCUMENTS

| | | | |
|---|---|---|---|
| 2,958,023 | 10/1960 | Edwards | 361/307 |
| 3,467,898 | 9/1969 | Ruffner | 361/321 |
| 3,487,456 | 12/1969 | Wildi | 200/278 |
| 3,561,110 | 2/1971 | Feulner et al. | 361/307 |
| 3,578,895 | 5/1971 | Caires | 361/307 |
| 4,400,594 | 8/1983 | Serras-Paulet | 335/206 |

*Primary Examiner*—E. A. Goldberg
*Assistant Examiner*—George Andrews
*Attorney, Agent, or Firm*—John T. O'Halloran; Robert P. Seitter

[57] ABSTRACT

A design of magnetic field actuated sealed electrical contact unit for an electrically operated relay or mechanically operated switch is constructed of metal and plastics laminae (1, 1*a*, 2, 2*a*, 5 and 5*a*) one of which incorporates a diaphragm 10 which functions both as moving contact and armature. In the case of a relay the electromagnetic energizing unit (3, 3*a*, 4 and 4*a*) may also be of laminar construction.

27 Claims, 35 Drawing Figures

ELECTRICAL CONTACT UNITS

This invention relates to magnetic field actuated electrical contact units for electrically operated relays and mechanicaly operated switches, and in particular to constructions of such contact units that employ an armature in the form of a lamina, which also functions as a moving contact of the contact unit. The use of such laminae for this purpose is described for instance in United Kingdom Patent Specifications Nos. 1021047, 1026564-7, 1094334, 1115401, 1063145, 1098145, 1213699 and 1492886, to which attention is directed.

Typically the construction of the contact units of these devices has involved the assembly of a number of parts, which have been made by differing types of technology, and hence it has been difficult to assemble such units in a cost effective way while maintaining tight mechanical tolerances.

According to the present invention there is provided a magnetic field actuated electrical contact unit for an electrically operated relay or a mechanically operated switch, which contact unit is constructed of metal and plastics laminae.

This use of laminae offers the possibility of considerable simplification of the assembly process. A tape of identical laminae, providing one piece-part of the contact unit, may be fed to a bonding station, where it is brought together in the requisite order with similar tapes providing other piece-parts. When all the piece-parts are appropriately registered with each other the laminae can be bonded together, optionally given a plastics protective coating for instance by electrostatic coating, and then individual sealed contact units can be cropped from the tapes. Conveniently the registry of the laminae prior to bonding can be controlled by means of locating index holes in the individual tapes.

In the construction of relays using this type of contact unit it is in some circumstances possible to adopt a laminar construction for the electromagnetic energising unit comprising coil, core, and yoke, and in this way the whole relay can be of laminar construction.

Figure 1:
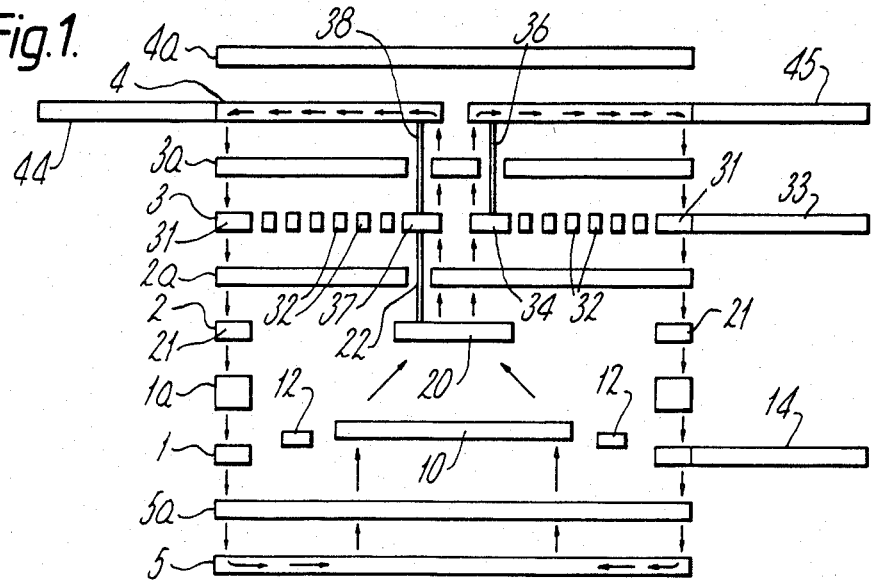
Figure 3:
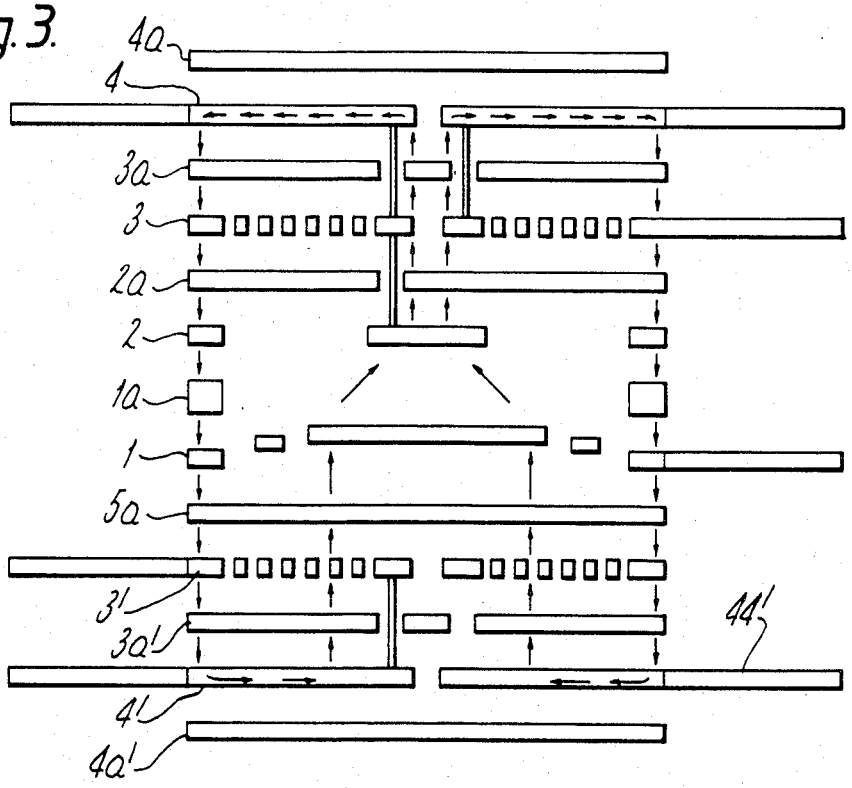
Figure 2:
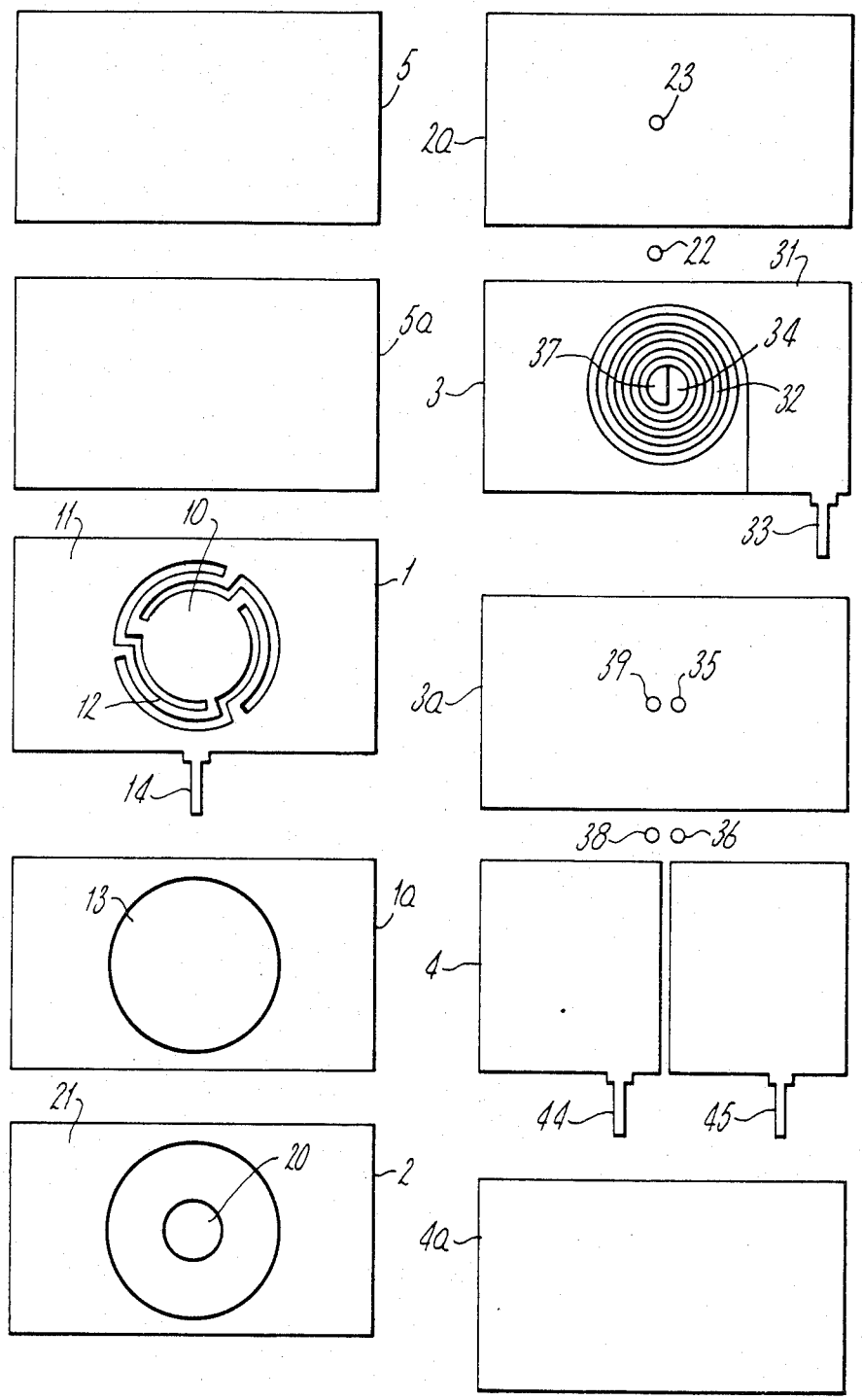
Figure 4:
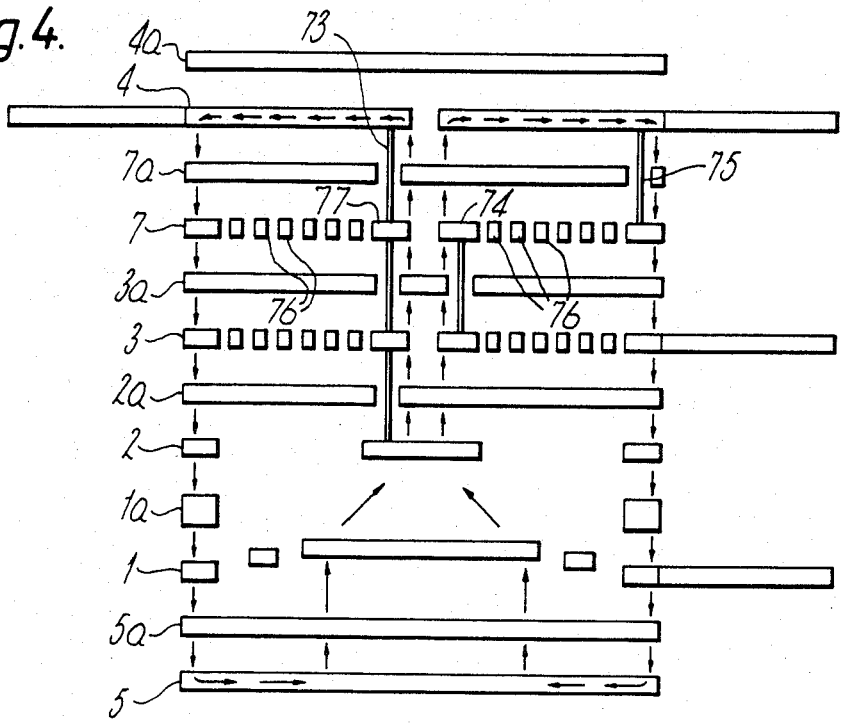
Figure 5:
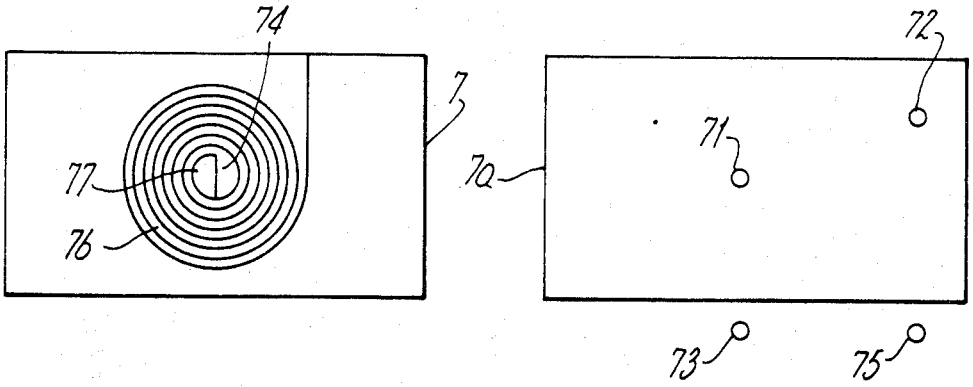
Figure 6:
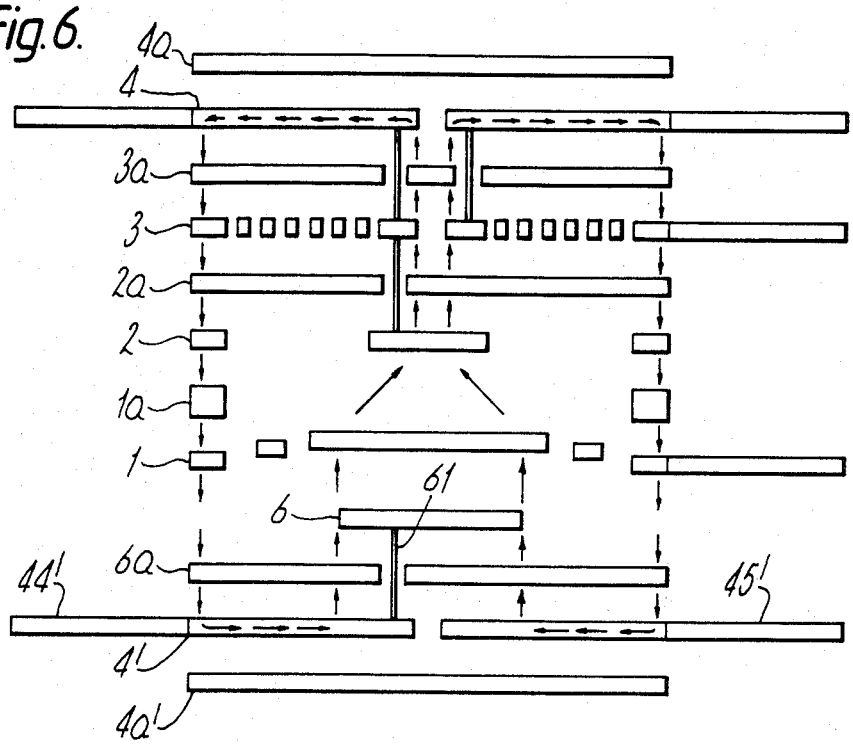
Figure 7:
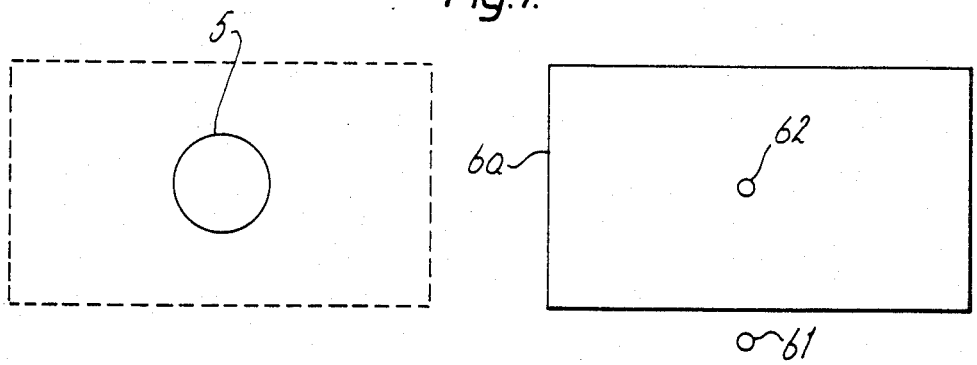
Figure 8:
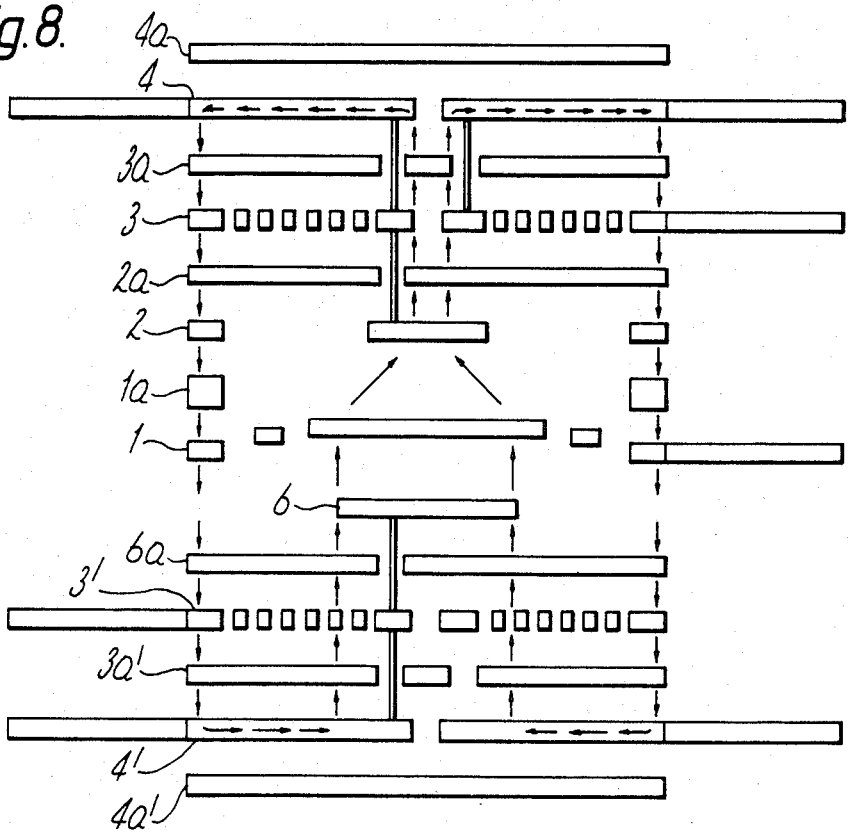
Figure 20:
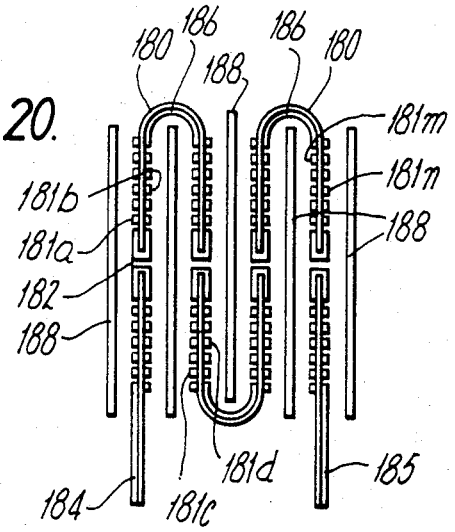
Figure 9:
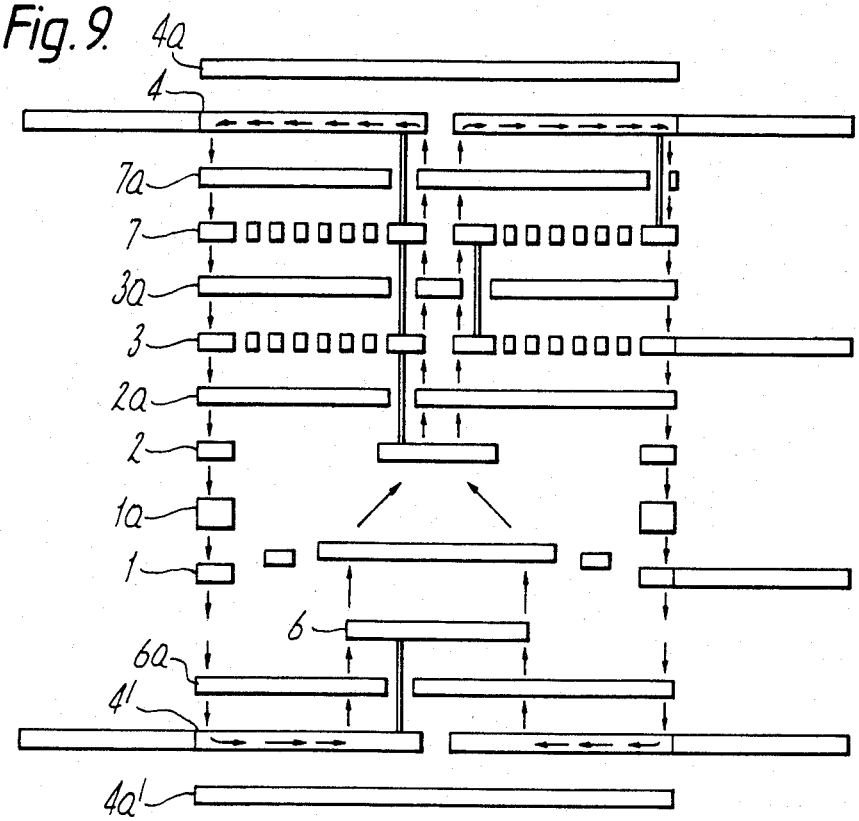
Figure 34:
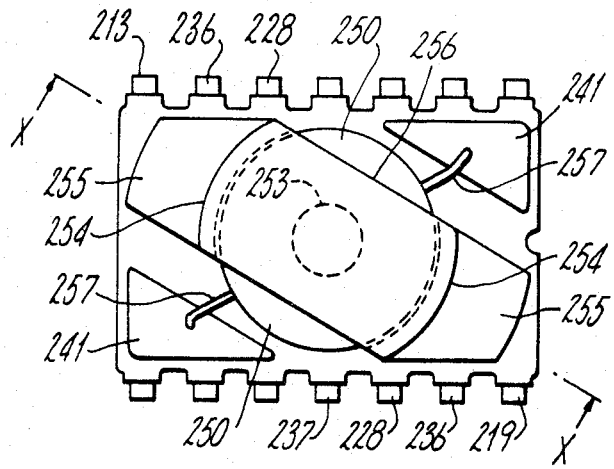
Figure 10:
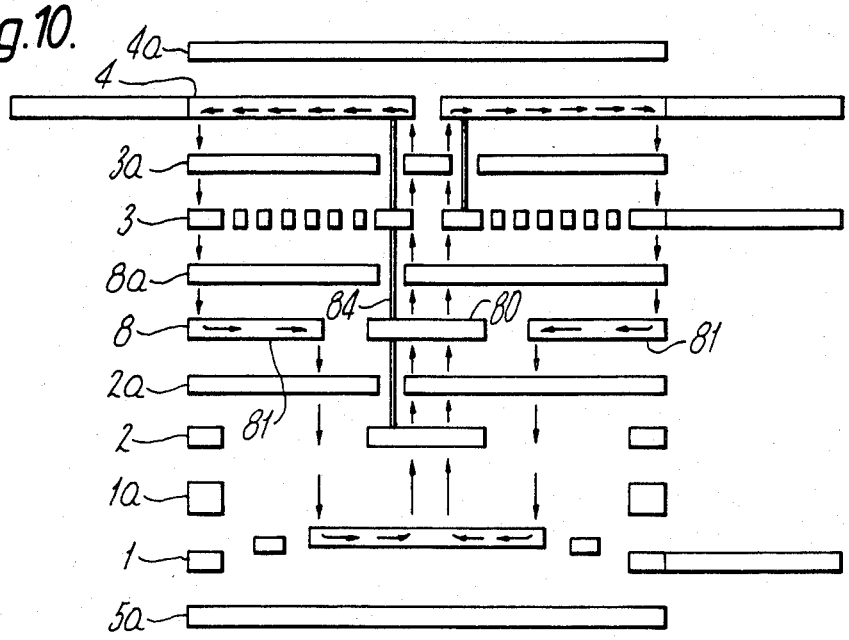
Figure 11:
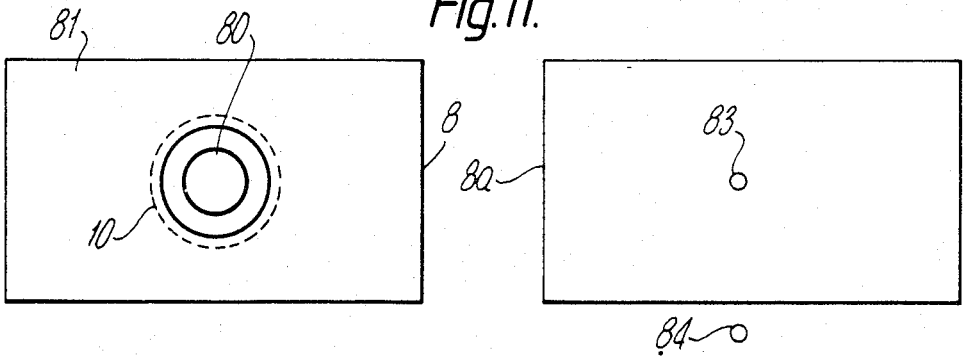
Figure 12:
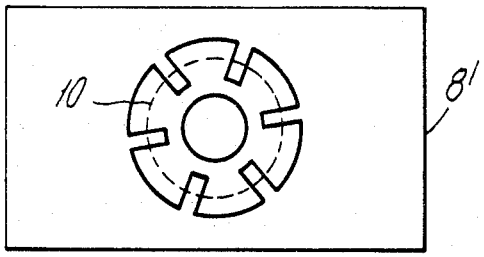
Figure 13:
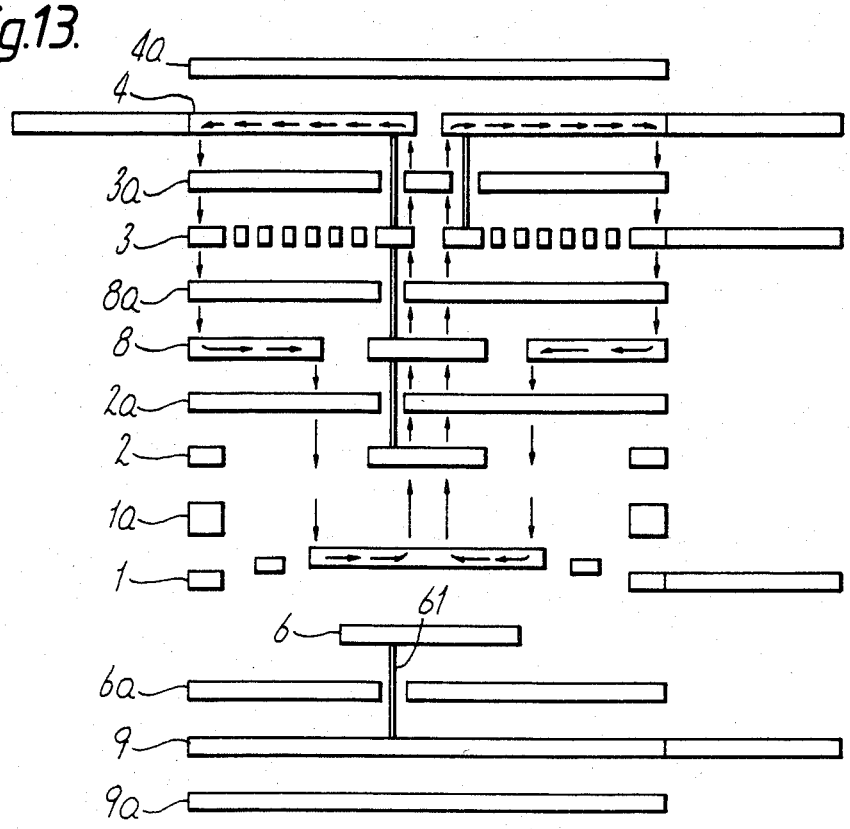
Figure 14:
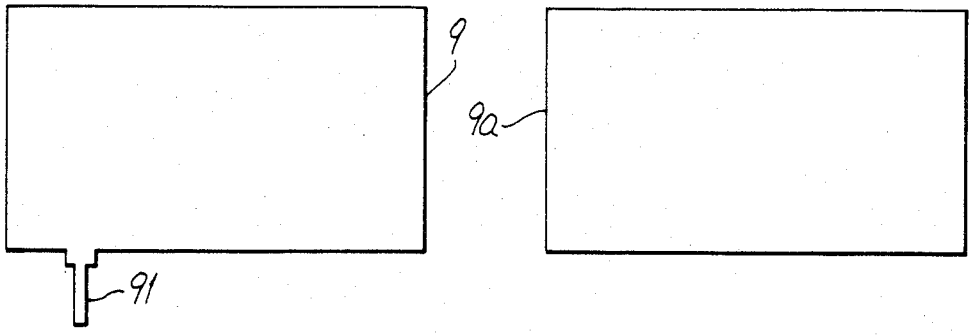
Figure 15:
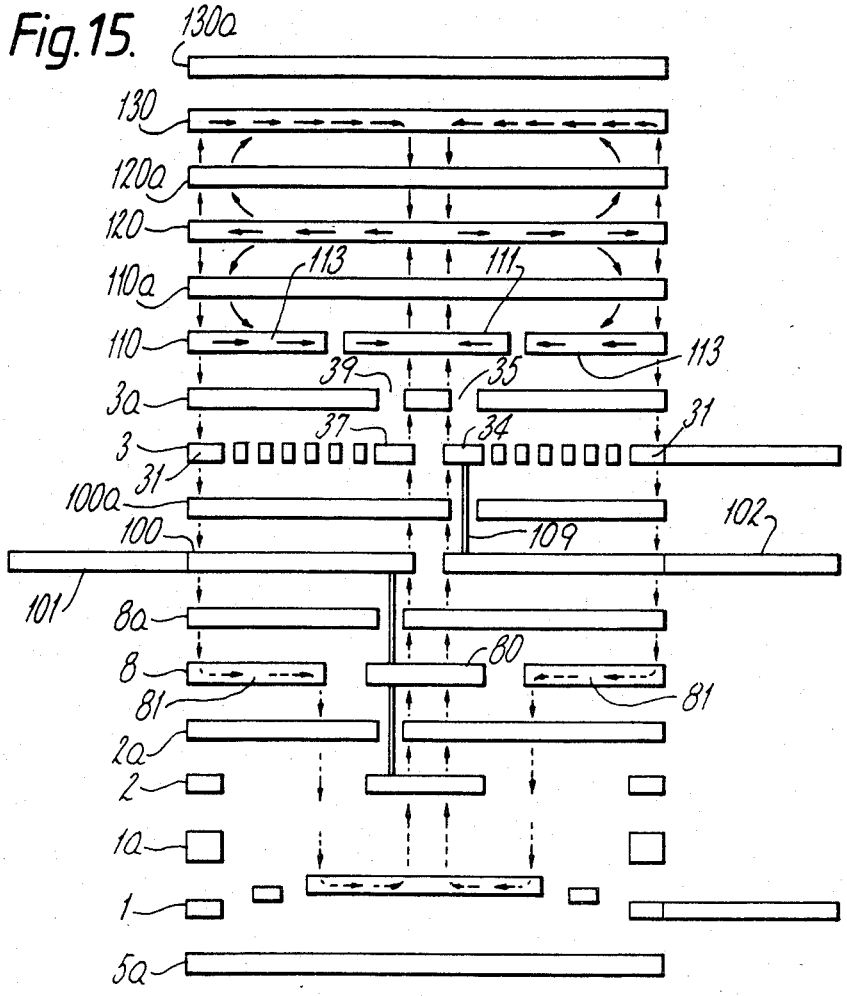
Figure 17:
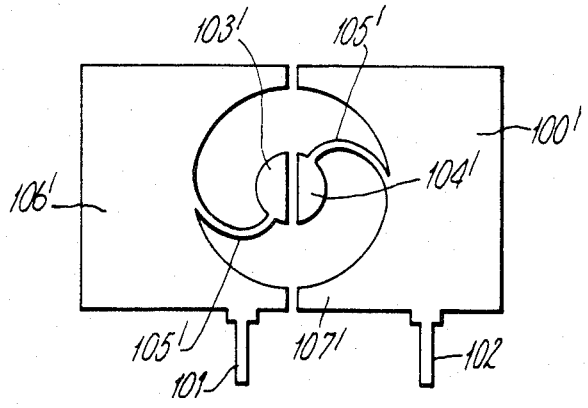
Figure 16:
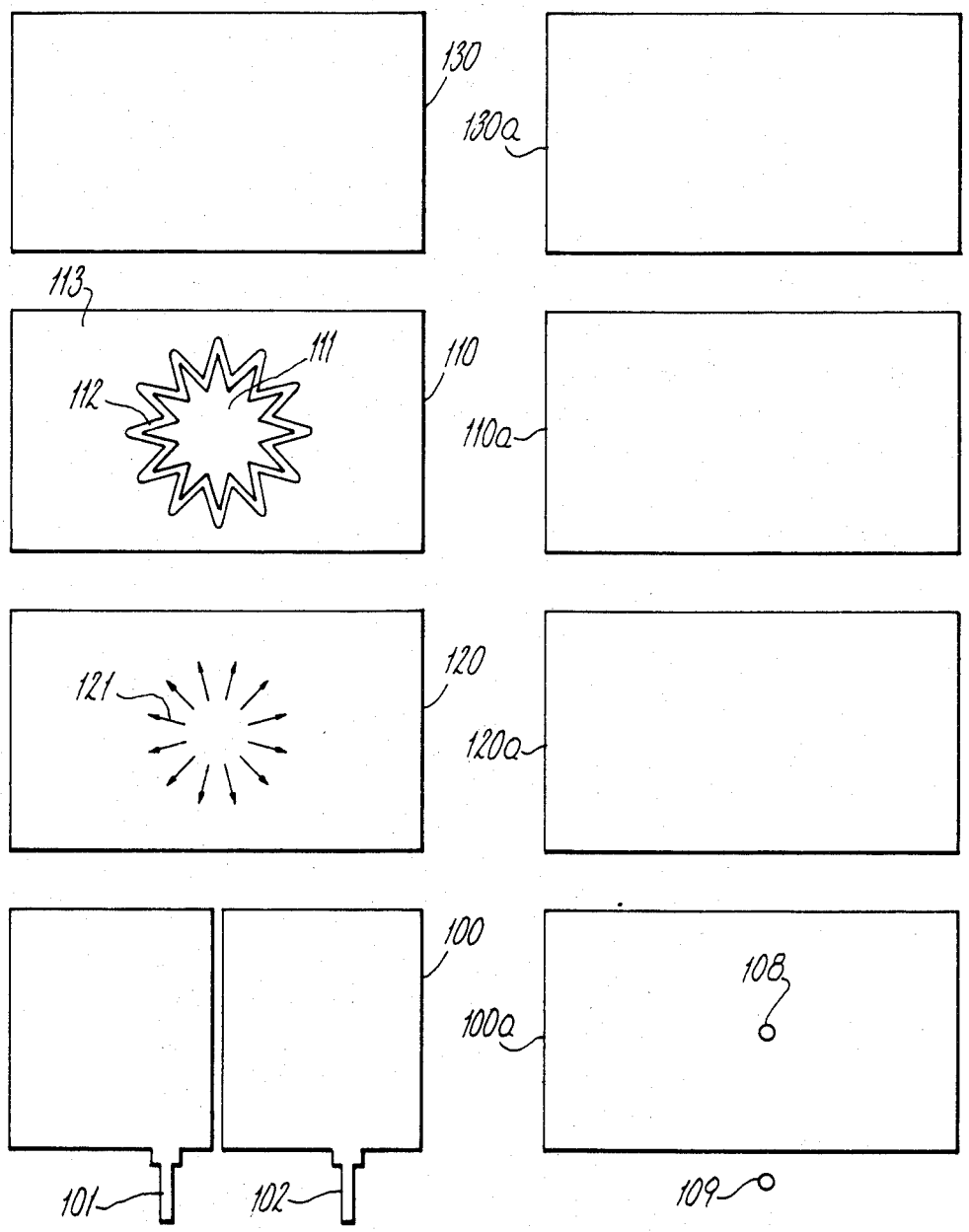
Figure 21:
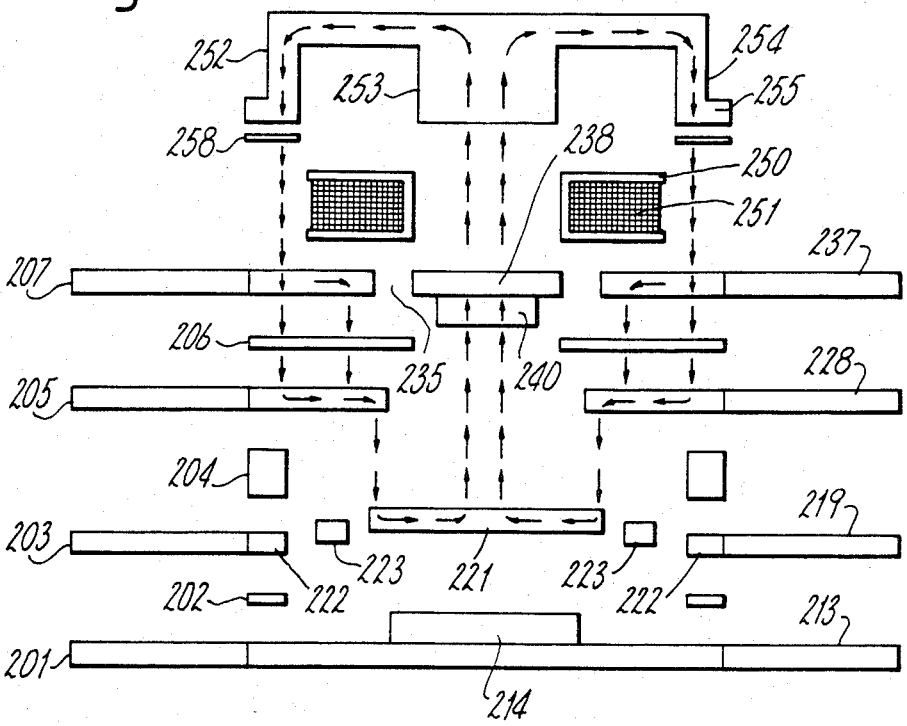
Figure 35:
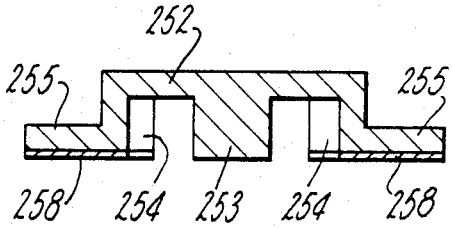

There follows a description of contact units and relays embodying the invention in preferred forms. The description refers to the accompanying drawings, in which:

FIG. 1 is an exploded schematic diagram of a single make relay,

FIG. 2 depicts the shape of the laminae from which the relay of FIG. 1 is constructed, FIG. 3 is a diagram of a modified version of the relay of FIG. 1 incorporating a second coil, FIG. 4 is a diagram of another modified version of the relay of FIG. 1 also incorporating a second coil, FIG. 5 depicts the shape of the additional laminae of the relay of FIG. 4, FIG. 6 is a diagram of a version of the relay of FIG. 1 modified to provide changeover contact operation, FIG. 7 depicts the shape of the additional laminae of the relay of FIG. 6, FIGS. 8 and 9 are diagrams of alternative versions of the relay of FIG. 6 incorporating second coils, FIG. 10 is a diagram of a version of the single make relay of FIG. 1 modified to provide an alternative configuration of magnetic circuit, FIG. 11 depicts the shape of the additional laminae of the relay of FIG. 10, FIG. 12 depicts the shape of a modified version of one of the laminae of FIG. 11, FIG. 13 is a diagram of a changeover contact operation version of the relay of FIG. 10, FIG. 14 depicts the shape of the additional laminae of the relay of FIG. 13, FIG. 15 is a diagram of a magnetically latched operation version of the relay of FIG. 10, FIG. 16 depicts the shape of the additional laminae of the relay of FIG. 15, FIG. 17 depicts the shape of a modified version of one of the laminae of FIG. 16, FIGS. 18, 19 and 20 depict an alternative form of laminar coil for use with these relays, FIG. 21 is a diagram of a design of changeover contact operation relay having a non-laminar construction of electromagnetic energising unit, FIGS. 22 to 33 depict the shape of the laminae of the relay of FIG. 21 and of the tapes from which these laminae are cropped, FIG. 34 depicts the assembled relay of FIG. 21, and FIG. 35 depicts a cross-section of its core and yoke piece-part.

FIG. 1 depicts an exploded sectional schematic representation of a single make laminar relay composed of metal-clad plastics laminae, while FIG. 2 depicts the configuration of its component laminae. (In these figures the metal part of each lamina is shown detached from its associated plastics part, whereas in actual practice in this particular relay the metal part will normally never have existed in that shape detached from its associated plastics part.) The face of each plastics part remote from its associated metal part is covered with a layer of adhesive for bonding it to the next lamina. In certain of the laminae the plastics parts serve as electrical insulation between the metal parts of adjacent lamina, and in those instances the plastics parts may extend beyond the outer edges of their associated metal parts to increase the length of the electrical leakage paths between the metal parts.

The only moving part of the relay of FIGS. 1 and 2 is an armature formed by the central region 10 of a ferromagnetic armature lamina 1 carried on a plastics supporting lamina 1*a*. The central region 10 is linked with a peripheral region 11 by three slender arcuate double cantilevers 12. When magnetic flux is excited around the relay, this flux enters the central region 10 from a ferromagnetic end lamina 5 carried on a plastics lamina 5*a*. It should be noted that the adhesive on lamina 5*a* is confined to a peripheral region opposite the peripheral region 11 of the armature lamina 1 so that the lamina 5*a* does not adhere to the double cantilevers 12. Within the central region 10 the flux converges radially to leave it at a higher flux density by way of the gap between the central region 10 and the central region 20 of a make contact lamina 2 electrically isolated from the peripheral region 21 and carried on a plastics lamina 2*a*. The area of overlap between the central region 10 of the armature and the central region 20 of the make contact is smaller than the area of overlap between the end lamina 5 and the central region 10 of the armature in order to provide the requisite ratio of flux densities to provide the nett attractive force urging the central region 10 of the armature into electrical contact with the central region of the make contact. Movement of the central region 10 of the armature through a hole 13 in the support lamina 2*a* under the influence of this attractive force is resisted by the resilience of the slender arcuate double cantilevers 12.

The magnetic flux entering the central region of the make contact passes through the centre of a spiral coil lamina 3 carried on a plastics lamina 3*a* to enter the central region of a ferromagnetic end lamina 4 carried on a plastics lamina 4*a*. It spreads out radially within the end lamina 4 to return to the other end lamina 5 by way of the outer region 31 of the coil lamina 3, the outer region 21 of the make contact lamina 2, and the outer region 11 of the armature lamina 1.

In this way a well defined magnetic circuit is provided. An increase in the electric current flowing through the coil increases the magnetic flux threading the magnetic circuit, thereby increasing the magnetic force of attraction between the central armature region 10 of the armature lamina and the make contact 20. This increasing force produces increasing deflection of the cantilever springs 12, reducing the gap between the two contacts and thereby the reluctance of the magnetic circuit. Eventually an avalanche threshold is reached, beyond which the extra attractive force resulting from reduced reluctance more than compensates the increasing restoring force of the cantilever springs. When this stage is reached the moving armature contact snaps across into firm contact with the make contact.

The ferromagnetic laminae may be made for instance of nickel iron (50%/50%). In the case of the armature lamina 1, this is cold rolled to provide the necessary springiness for the cantilever springs formed by the arcuate double cantilevers 12, whereas the other laminae may be soft, and are preferably made from annealed material. Clearly all the ferromagnetic laminae should be made of material having a high magnetic permeability and high saturation value of magnetic flux density so that they can be made relatively thin without engendering problems of saturation or of excessive reluctance. It may be noted that for applications in which the high conductivity of copper is not of overriding importance it may be advantageous to construct the coil lamina of a ferromagnetic material, such as nickel rather than of copper, so as to reduce its contribution to the reluctance of the magnetic circuit.

One terminal for the coil is provided by a terminal tag 33 on the coil lamina itself. A spiral is etched through this lamina to define a spiral track 32 terminating in a Dee-shaped pad 34 at the centre. The supporting plastics lamina 3*a* is provided with an aperture 35 registering with the pad 34, and this aperture is filled with a solder preform 36. When the laminae are assembled the solder preform is fused to form a permanent electrical connection between the pad 34 and one half of the end lamina 4. This half is provided with a terminal tag 45 which serves as the other terminal connection for the relay coil formed by the spiral track 32.

The other half of the end lamina 4 is provided with a terminal tag 44 which serves as the terminal connection for the make contact 20 of the relay. Electrical connection between the make contact and the terminal tag is established via a solder preform 22 inserted in an aperture 23 in the plastics lamina 20 supporting the make contact, an electrically isolated second Dee-shaped pad 37 at the centre of the coil lamina 3, and a solder preform 38 in a second aperture 39 formed in its supporting plastics lamina 3*a*. The corresponding terminal connection for the moving contact formed by the central region 10 of the armature lamina 1 is provided by a terminal tag 14 integral with the peripheral region 11. The terminal tags are arranged so that the relay can be mounted by its tags on a printed circuit board in what is commonly called Single In-Line (SIL) configuration. Alternatively additional terminal tags can be positioned in dual-in-line (DIL) configuration for mounting the relay in a plane parallel with that of the board.

If desired, the facing surfaces of the central region 10 of the armature lamina and that of the make contact lamina may be spot plated, for instance with gold, to improve their contact making properties. Similarly the terminal tags may be spot plated to improve their solderability and to strengthen them.

When the various lamina forming the relay are assembled and secured together they cooperate to form a sealed enclosure for the relay contacts. The sealing of the relay may be improved by covering the whole relay, with the exception of its terminal tags, with a conformal coating which may be in the form of a conventional plastics resin.

A typical format of relay is 10 mm high (excluding terminal tags), 17.5 mm wide, and between 1 and 2 mm thick. The plastics carrier laminae may be typically 0.1 mm, thick except for lamina 1*a* which will typically be slightly thicker, at 0.15 mm, to provide adequate spacing between the make contact and the armature in its rest position. The armature and the coil laminae 1 and 3 are typically 0.75 mm thick, the make contact lamina 2 can be somewhat thinner, at 0.05 mm thick, while the end laminae 4 and 5 are typically somewhat thicker, at about 0.1 mm, to accommodate easily the magnetic field within their thickness. The diameter of the central region 10 of the armature lamina is typically 5 mm, while that of the central region 20 of the make contact lamina is typically 2.5 mm. The diameter of the aperture in the outer part 11 of the armature lamina that houses the inner part 10 and its double cantilevers 12 is typically 8 mm and substantially equal to the outer diameter of the track 32 forming the relay coil. The diameter of the Dee-shaped pads 34 and 37 is substantially equal to that of the make contact 20.

It will be appreciated that the laminar design readily permits adaptation, for instance, additional laminae may be provided so that the coil operates two or more contact units that are magnetically in tandem.

In FIG. 3 the relay of FIGS. 1 and 2 is modified by the inclusion of a second coil. For this purpose the ferromagnetic end lamina 5 is omitted and replaced with a second assembly of coil lamina 3', support lamina 3*a'*, ferromagnetic end lamina 4', and support lamina 4*a'* secured with adhesive to the plastics support lamina 5*a*. The support lamina 5*a* is retained so as to insulate the coil lamina 3*a'* from the armature lamina 1. The four laminae of the second assembly may be identical with their counterparts at the other end, but are arranged in reverse order. Furthermore, although a solder preform is needed to establish electrical connection between the inner end of the coil and one half of the end lamina 4', no solder preform is required for the other aperture in lamina 4*a'* since no electrical connection is required between the other half of the end lamina 4' and the isolated pad of the coil lamina 3'. Terminal tag 44' is therefore unused, and may be cropped off.

The particular positioning of the second coil in the relay of FIG. 3 is chosen so that the same laminae can be used for both coils of the assembly. It will be evident that other positions of the second coil are possible if a coil of different configuration is used, and further that under these circumstances the relay can incorporate more than two coils.

The configuration of relay connection in FIG. 3 requires an external connection to be made to wire the two coils in series. This is not required in the two-coil version of relay depicted in FIG. 4. The relay of FIG. 4 is identical with that of FIGS. 1 and 2, with the exception that it includes an additional coil lamina 7 and supporting plastics lamina 7*a* (FIG. 5) inserted between the first coil supporting lamina 3*a* and the end lamina 4.

The coil 76 of coil lamina 7 spirals in the opposite sense to that of the coil of coil lamina 3, and it has isolated and non-isolated Dee-shaped pads 77 and 74 identical in shape and registering with the corresponding pads 37 and 34 on coil lamina 3. Thus the solder preform 36 in this instance provides an electrical connection between the inner ends of the two coils. The supporting lamina 7*a* is provided with two apertures 71 and 72 in which solder preforms 73 and 75 are inserted to make electrical connection between the isolated pad 77 and terminal tag 44 on one half of the end lamina 4, and between the outer end of the second coil and terminal tag 45 on the other half of the end lamina 4.

FIG. 6 depicts a changeover contact type relay. This uses the same components as the single make contact relay of FIG. 1, except that the end lamina 5 and its supporting plastics lamina 5*a* is replaced with an end lamina 4′ and supporting plastics lamina 4*a*′ identical with the corresponding laminae 4 and 4*a*, which are spaced from the armature lamina by a non-ferromagnetic break contact lamina 6 supported on a plastics lamina 6*a* (FIG. 7). The break contact 6 is typically made of copper or of nickel plated copper, and may have its contact face plated, for instance with gold, to improve its contact making properties. In this changeover contact relay the outer region 11 of the armature lamina is secured with adhesive against the plastics lamina 6*a*, and so the break contact lamina, which consists solely of a disc, pushes the central diaphragm region 10 of the armature forward against the action of its cantilever springs 12, thereby providing the necessary contact force between the moving contact and the break contact when the relay is in its unenergised position. The break contact is electrically connected with terminal tag 44′ on one half of end lamina 4′ by means of a solder preform 61 inserted in an aperture 62 in the break contact support lamina 6*a*. The terminal tag 45′ on the other half is unused and may be cropped off.

For a two coil version of the changeover contact relay, the relay of FIG. 6 may be modified by the inclusion of a second coil lamina 3′ and supporting lamina 3*a* as depicted in FIG. 8, or by the inclusion of a second coil lamina 7 and supporting lamina 7*a* as depicted in FIG. 9.

In all these changeover contact relays the relative sizes and spacing of the central diaphragm region 10 of the armature, of the make contact 20, and of the break contact 6 are such as to prevent, geometrically, the possibility of the diaphragm ever making simultaneous contact with both fixed contacts. The geometry could however, be altered in order to change from break-before-make operation to make-before-break.

FIG. 10 depicts a modified version of single make contact relay of FIGS. 1 and 2 in which the ferromagnetic end lamina 5 is omitted, and a ferromagnetic flux return lamina 8 supported on a plastics carrier lamina 8*a* is inserted between the make contact plastics carrier lamina 2*a* and the coil lamina 3. The coil lamina 3 is secured with adhesive to the plastics lamina 5*a*.

The purpose of the flux return 8 is to redirect the magnetic flux so that it enters and leaves the central diaphragm 10 of the armature from the same side. In this way the magnetic forces generated across both gaps are additive rather than in opposition as is in the case of the relay configuratuons described previously. The shape of the flux return lamina 8 and its supporting lamina 8*a* is depicted in FIG. 11. The flux return lamina has a central region 80 of substantially the same size as that of central region 20 of the make contact lamina. An annular gap separates the central region 80 from a peripheral region 81. The peripheral region 81 has to be overlapped in part by the central diaphragm region 10 of the armature of the relay so as to provide a low reluctance path between these two integers, but on the other hand the peripheral region 81 should not approach too close to the central region 80 or it will provide an unacceptably low reluctance path shunting the armature. Therefore the tolerances on the relative diameters are liable to be relatively tight. These tolerances can be somewhat reduced by adopting the castellated aperture design of the alternative shape of flux return lamina 8′ depicted in FIG. 12. In each instance the plastics support lamina 8*a* has an aperture 83 in which a solder preform 84 is inserted for making electrical connection between the central region of the flux return lamina and the isolated pad of the coil lamina.

FIG. 13 depicts a changeover contact version of the relay of FIG. 10. This uses the same components as the relay of FIG. 10, with the exception that the plastics lamina 5*a* is replaced with the combination of a metal lamina 9 on a plastics support lamina 9*a* and a non-ferromagnetic contact lamina 6 on a supporting plastics lamina 6*a*. The break contact lamina 6 and its supporting lamina 6*a* are identical with their counterparts in the changeover contact type relays of FIGS. 6 and 8, and the lamina 6*a* is similarly secured with adhesive to the peripheral region 11 of the armature lamina 1. The shape of the laminae 9 and 9*a* is depicted in FIG. 14. Lamina 9 is provided with a terminal tag 91 electrically connected with the break contact via the solder preform 61 inserted in the aperture 62 in the break contact support lamina 6*a*.

FIG. 15 depicts a magnetically latching version of the single make contact relay of FIG. 10. In this relay the end ferromagnetic lamina 4 and its supporting plastics lamina 4*a* are replaced by a shunted permanent magnet assembly formed by the series combination of ferromagnetic laminae 110,120 and 130 and their associated plastics supporting laminae 110*a*, 120*a* and 130*a* interposed between the coil lamina 3 and the flux return support lamina 8*a* is a further lamina 100 and its plastics support lamina 100*a*. The configuration of these eight new laminae is depicted in FIG. 16. The heart of the shunted permanent magnet assembly is formed by lamina 120, which is made of a hard permanent ferromagnetic material, and is radially magnetised as depicted by arrows 121 (FIG. 16). This is shunted on one side by lamina 130, and on the other by lamina 110, both of which are made of soft magnetic material. This use of shunts makes the permanent magnet less affected by external magnetic influences. Lamina 110 has a central region 111 separated by a gap 112 from a peripheral region 113. The width and length of this gap is designed to provide a low magnetic reluctance between the inner and peripheral ferromagnetic parts of the lamina. Looking from the gap 112 into the shunted permanent magnet assembly, it appears, magnetically, to be a permanent magnet assembly of relatively small magneto-motive force and low magnetic reluctance. Preferably the design is such that the reluctance matches that of the magnetic circuit of the rest of the relay.

Lamina 100 is divided into two halves provided with terminal tags 101 and 102 which form respectively the terminal connections for the make contact and the inner end of the coil. This lamina is made of electrically conductive non-ferromagnetic material so that it shall not form a low reluctance magnetic path shunting the contact assembly. On the other hand the use of a non-ferromagnetic lamina increases the reluctance of that part of the magnetic circuit between the outer part 81 of the flux return lamina 8 and the outer part 31 of the coil lamina 3, and also between their respective inner parts 80 and 34,37.

An alternative design of lamina permitting the use of ferromagnetic material is depicted in FIG. 17. This alternative design, designated 100', has a pair of Dee-shaped pads 103', 104' corresponding in size and orientation with the pads 34, 37 of the coil lamina. A gap traversed by a pair of thin webs 105' separates these pads from an outer region formed in two halves 106', 107' which co-operate to form a shape corresponding with the outer region 31 of the coil lamina. The thin webs 105' are designed to provide a low saturation magnetic path between the inner and outer parts of the lamina so that their magnetic shunting effect is minimised.

The plastics support lamina 100*a* has the same configuration for both designs of lamina 100, 100', and is provided with an aperture 108 in which a solder preform 109 is inserted for making electrical connection between lamina 100 (100') and lamina 3. Since no electrical connection is required between lamina 3 and lamina 110, no solder preforms are inserted in the aperture 35 and 39 of the coil plastics support lamina 3*a*.

When the shunted permanent magnet assembly is assembled with the rest of the relay, the magneto-motive force developed across the two ferromagnetic parts 111 and 113 of lamina 110 produces a magnetic flux through the relay as shown by the broken arrows 150. This tends to attract the central armature moving contact region 10 of lamina 1 towards the make contact provided by the central region 20 of lamina 2. In the unoperated condition of the relay the force of attraction is insufficient to cause the moving contact to come into contact with the make contact.

An 'operate' pulse of electric current can be passed through the coil lamina 3 in such a direction as to increase the flux threading the gap between the armature moving contact and the make contact. This will cause the moving contact to move further towards the make contact, with the result that the magnetic reluctance between the armature moving contact and the flux return, is reduced. This causes some of the magnetic flux from the permanent magnetic lamina to be diverted from threading the gap in lamina 110 to threading the armature. The relay is designed so that, if the pulse is large enough to cause the armature moving contact to avalanche into contact with the make contact, then the amount of flux diverted is sufficient for the magnetic force of attraction to retain the moving contact against the make contact even after the pulse has terminated.

If a 'release' pulse of current is now passed in the opposite direction through the coil, this will decrease the amount of flux threading the armature. If this flux is decreased sufficiently to cause the moving contact to lift off the make contact, then sufficient flux is redirected once again to thread the gap 112 for the moving contact to remain lifted off even after the pulse has terminated. In this way a bistable relay is provided that will remain indefinitely in either the released or the operated state with the coil unenergised. It is to be noted that the shunt for the permanent magnet tends to shield the permanent magnet from the demagnetising effects of 'release' pulses, and furthermore it is shielded on one side by lamina 120 and on the other by lamina 130 so that there is minimal magnetic interaction between it and its surroundings outside the relay.

It will be apparent that the relay of FIG. 15 can readily be modified to incorporate a second coil, for instance substantially after the manner already described with reference to FIG. 4. Similarly, the single make contact version of relay as described with reference to FIG. 15, or its multi-coil equivalent, can be modified to include a break contact to provide a changeover contact version of operation. This modification may be substantially after the manner already described with reference to FIG. 13.

Figure 18:
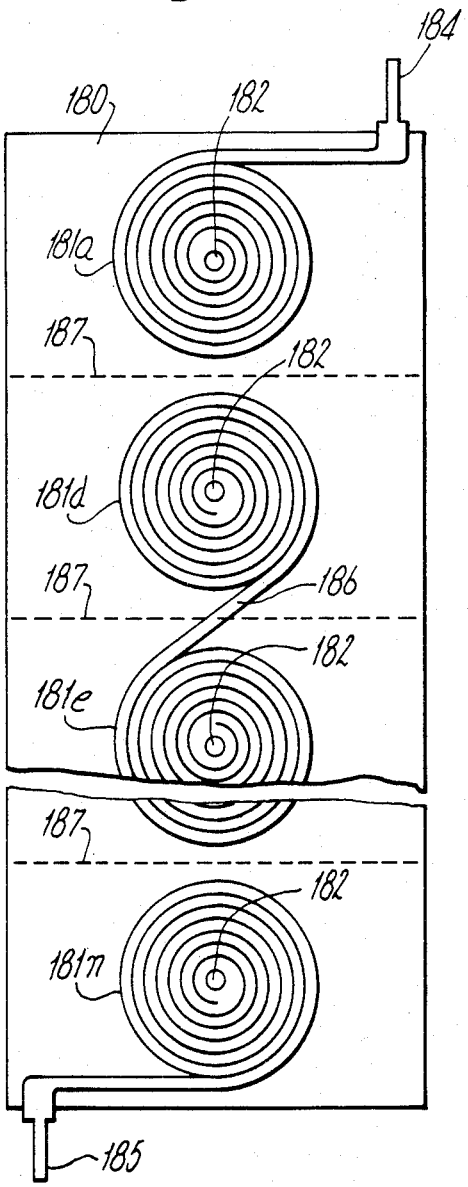
Figure 19:
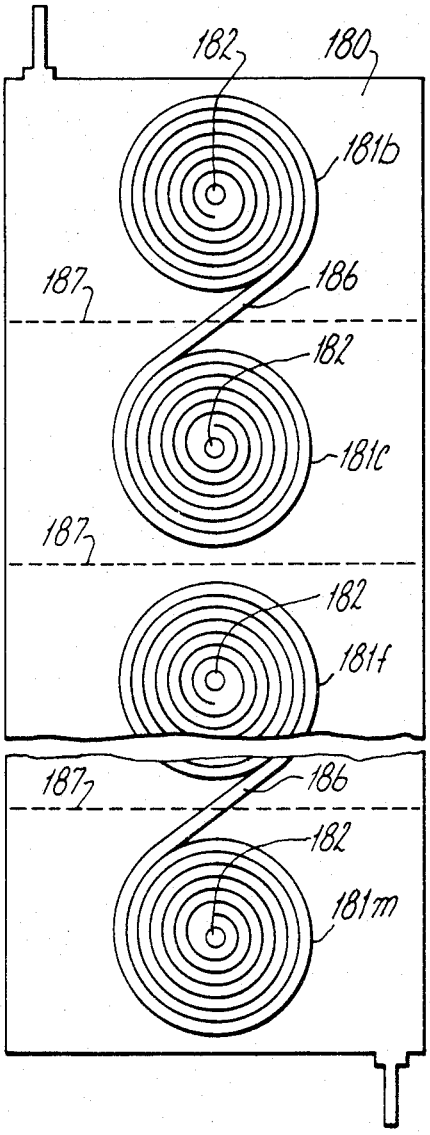

The relay of FIG. 3 uses two coils, which are physically separated from each other, and so have to have an external connection for them to be operated in series. The relay of FIG. 4 has the two coils next to each other so that they can be series connected by means of a solder preform. This use of a solder preform can be dispensed with by using the fan-folded (concertina-folded) type of coil assembly depicted in FIGS. 18, 19 and 20. FIGS. 18 and 19 show respectively the front and back faces of a double sided etched tape consisting of two metal laminae carried on opposite faces of a plastics support lamina 180. The metal laminae are etched to define spiral coils 181*a*, 181*b*, 181*c*, 181*d*, 181*e*, 181*f*, 181*g*, 181*h*, 181*i*, 181*j*, 181*k*, 181*l*, 181*m*, 181*n*. Each coil is connected at its centre to the centre of a coil on the opposite side by way of a plated through connection threading apertures 182 in the support lamina 180. All the coils are of the same sense. The outer ends of the two extreme coils 181*a* and 181*n* are connected respectively to terminal tags 184 and 185, while the outer ends of all the other coils are connected in pairs by means of tracks 186. By this means a multilayer coil is formed when the tape is fan-folded (folded concertina-fashion) along the lines 187. Interleaved insulating laminae 188 (FIG. 20) prevent the two coils facing each other on the inside of each fold from being shorted.

It will be appreciated that this coil assembly cannot be directly substituted for any of the coils of the previously described relays without making minor modifications to avoid taking the make contact terminal connection to its terminal tag 44 through the centre of the coil. In the case of a relay incorporating a flux return lamina such as illustrated in FIG. 10, this can be achieved by using a non-ferromagnetic lamina 2 for the make contact. In which case, because it does not form a magnetic shunt, it does not need any isolation between its central and peripheral zones, and therefore it can be made as an uninterrupted sheet capable of having an integral terminal tag. Alternatively a ferromagnetic make contact lamina can be used provided with a meandering low magnetic saturation web linking the central and peripheral regions 20 and 21 analogous with the web 105' of the lamina 100' of FIG. 17.

All the relays described with particular reference to FIGS. 1 to 20 have been entirely laminar in construction, and their metal laminae have been supported on plastics laminae. Considerations of space and electrical performance for some applications of relay make it preferable to depart from this, and to use free-standing metal laminae and possibly to use a non-laminar construction of coil, and core and flux return assembly. Such a relay will now be described with particular reference to FIGS. 21 to 35. This relay is a changeover contact operation relay whose contact unit is constructed from an assembly of seven laminae 201 to 207 made up of four metal laminae comprising a break contact lamina 201, an armature lamina 203, a flux linking lamina 205, and a make contact lamina 207, these four laminae being separated from each other by electrically insulating spacer laminae 202, 204 and 206.

Figure 22:
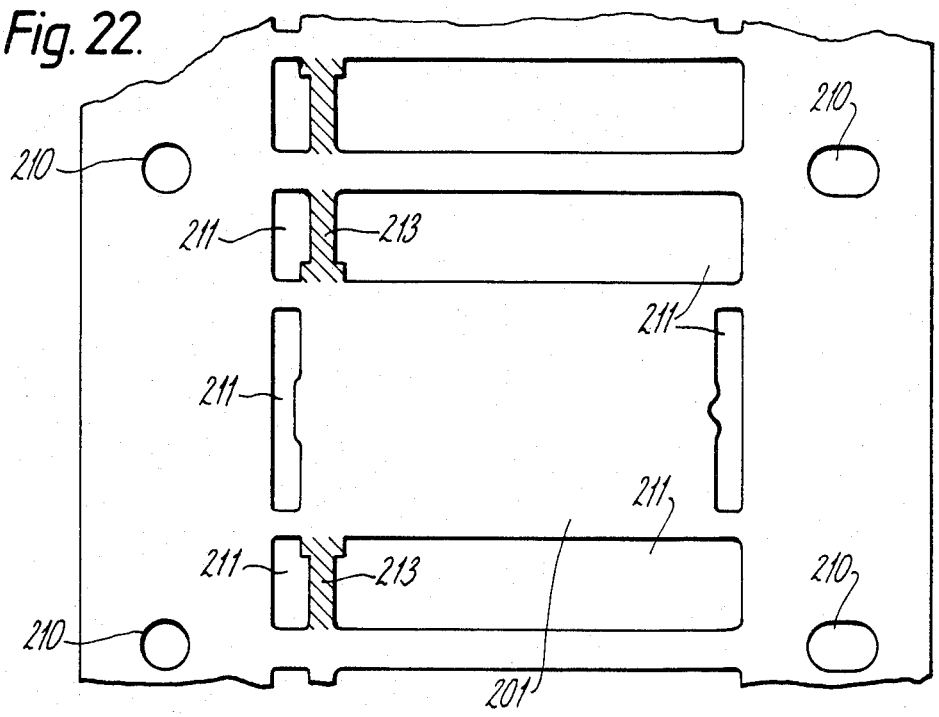
Figure 23:
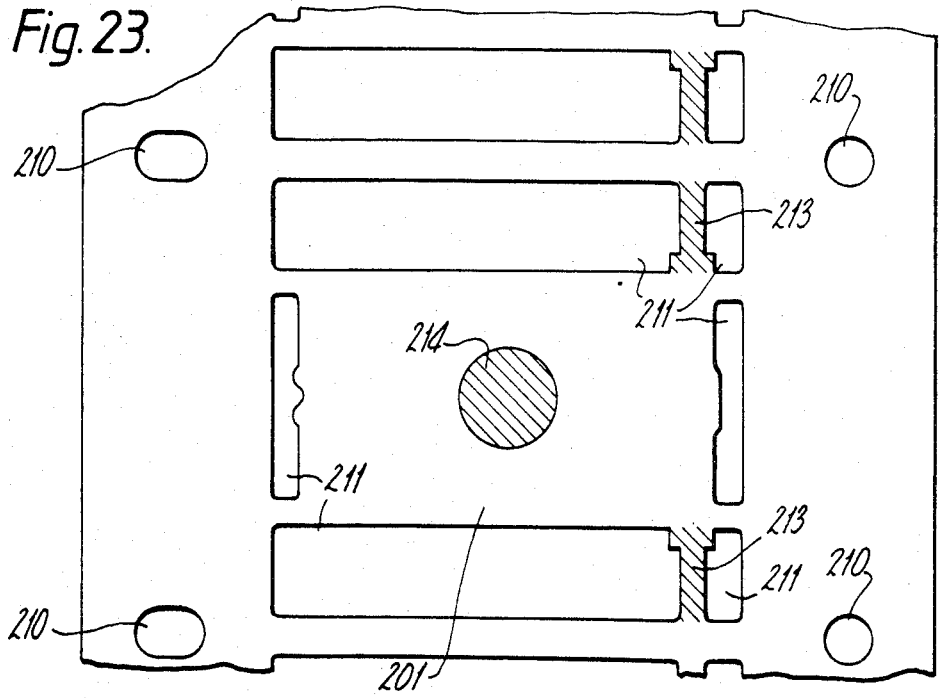

All the lamina are prepared and assembled in tape form, and FIGS. 22 to 33 showed the shapes of these tapes. The break contact 201, whose front and rear faces are depicted in FIGS. 22 and 23 respectively, is made from 35 mm wide 0.1 mm thick nickel sheet provided with locating holes 210 at a standard pitch. Apertures 211 define a generally rectangular piece-part 201 with two terminal tags 213. On the rear face a circular region 214, which is to form the actual break contact of the relay, is made locally thicker, for instance either by electroforming or by welding on an additional piece of material, so that it stands approximately 0.17 mm proud, and is provided with a precious metal surface coating, for instance of gold, to improve its contact making properties. The terminal tags 213 are also plated on both surfaces in the regions indicated by hatchings. The whole of the rear face of each break contact lamina 201, with the exception of its contact boss 214 and its terminal tags 213, is coated with a thin layer of adhesive (not shown).

Figure 24:
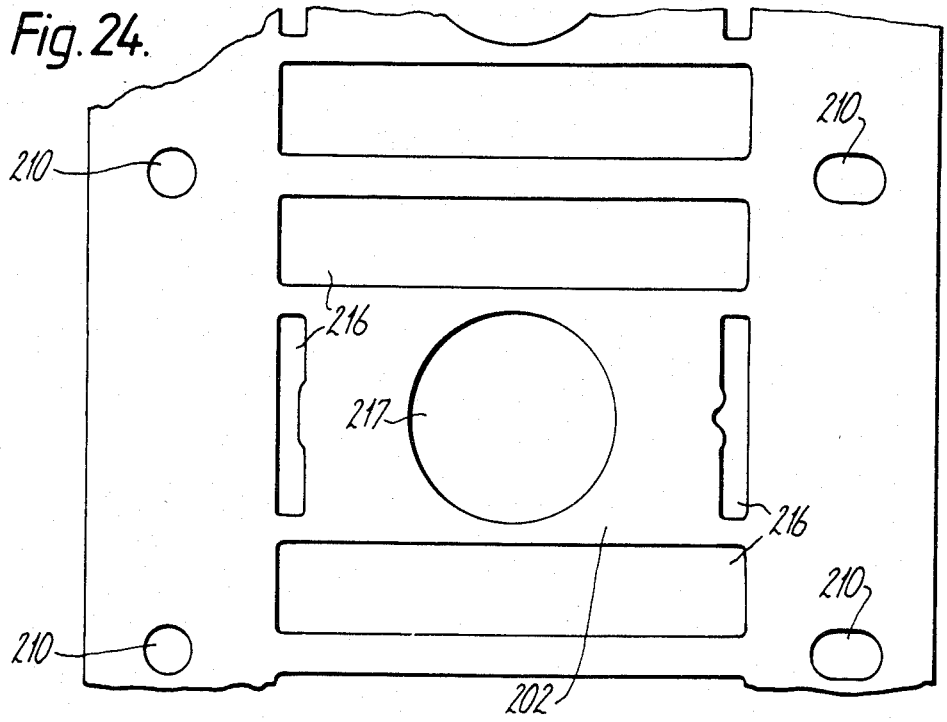
Figure 25:
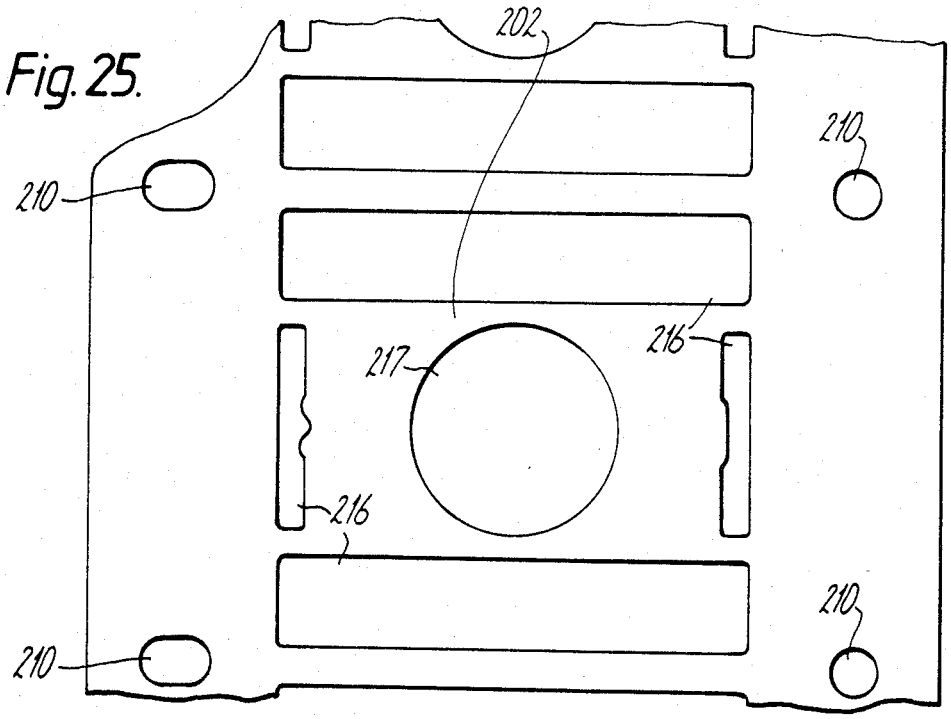

FIGS. 24 and 25 depict respectively the front and rear faces of the tape of spacer laminae 202. This tape, like all the other tapes of the assembly, is a 35 mm wide tape provided with locating holes 210 at a standard pitch by which all the tapes can be brought into registry with each other. This particular tape is made of a polyimide film approximately 50 microns thick, and, in addition to the apertures 216 defining the rectangular shape of the laminae 202, a central aperture 217 in each spacer lamina provides generous clearance for the protruding boss 214 of the break contact lamina.

Figure 26:
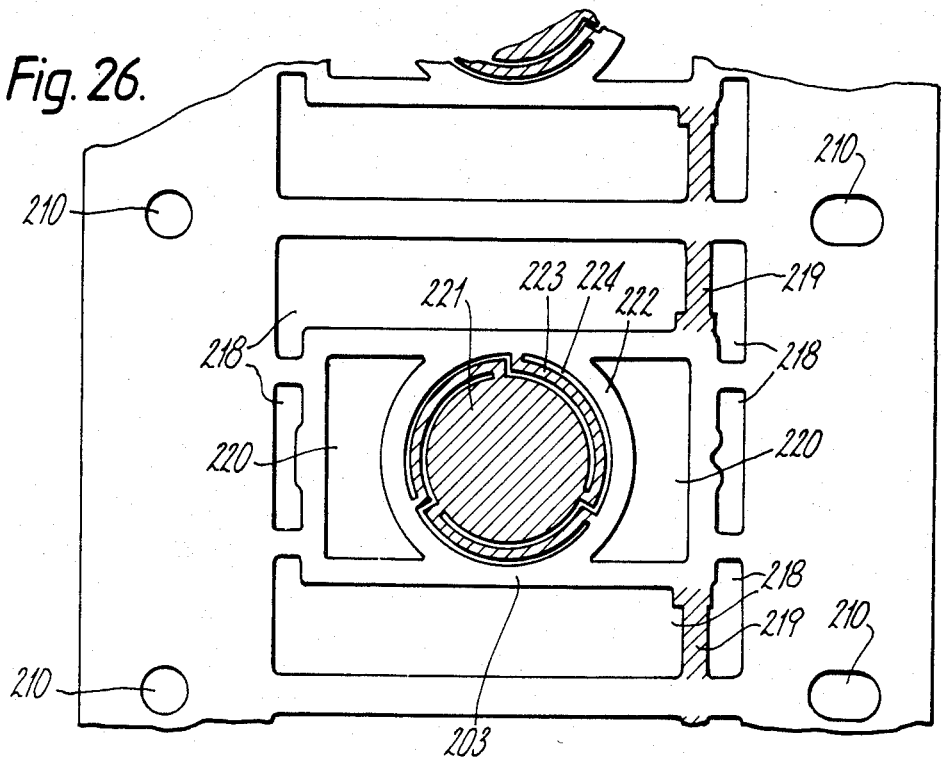
Figure 27:
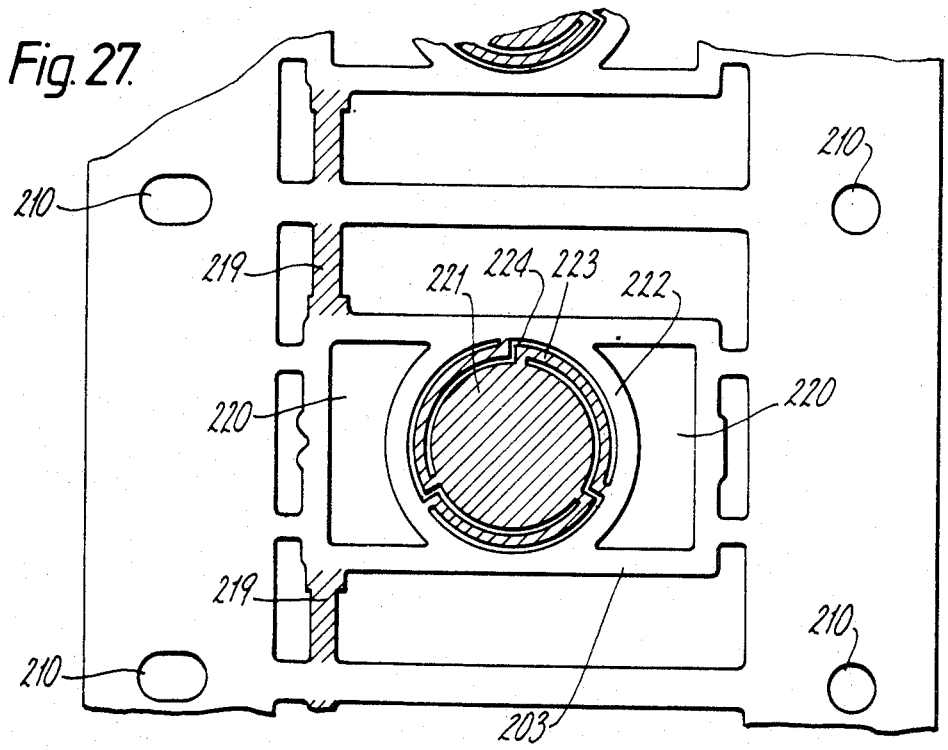

FIGS. 26 and 27 depict respectively the front and rear faces of the tape of armature laminae 203. This tape is approximately 0.075 mm thick, and is made of nickel-iron (50%/50%) in a rolled condition (not annealed). Apertures 218 serve to delineate the rectangular shape of the laminae and their terminal tags 219. Further apertures 220 delineate a circular portion of each lamina containing the armature, which also functions as the moving contact of the relay. The armature has the same general shape as that of the armatures of the relays described previously, and has a central region 221 linked with a peripheral region 222 by three slender arcuate double cantilevers 223 delineated by apertures 224. Both faces of the armature central region 221 and of its double cantilevers 223 are plated with precious metal, for instance with gold, and both faces of both tags are similarly plated. The unplated areas of the lamina are coated with a thin film of adhesive (not shown).

The tape of spacer laminae 204 is not separately illustrated since these laminae are identical with laminae 202 except that they are about 250 microns thick instead of about 50 microns.

Figure 28:
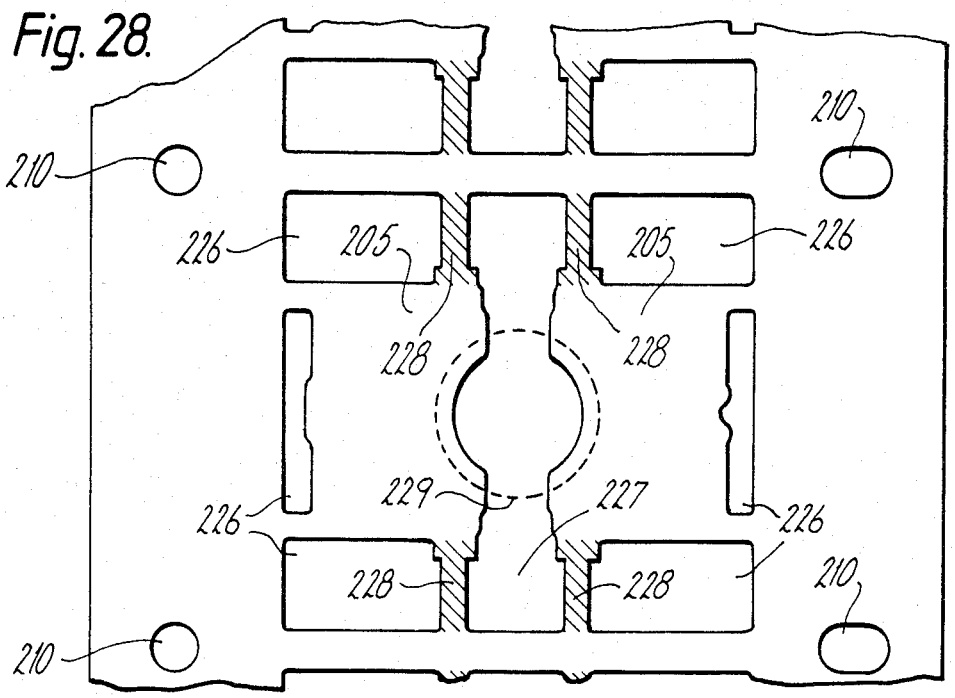
Figure 29:
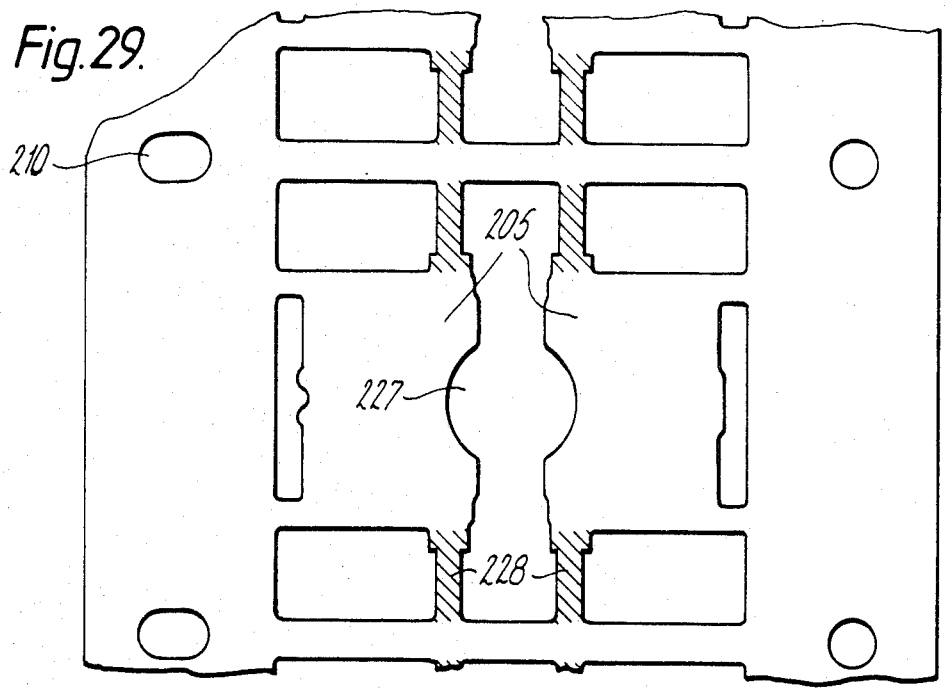

FIGS. 28 and 29 depict respectively the front and rear faces of the tape of flux linking laminae 205 made from 0.1 mm thick nickel sheet. Apertures 226 define the generally rectangular shape of the flux return lamina, and co-operate with a further aperture 227, which divides each lamina into two halves, to define terminal tags 228. In this particular design no electrical use is made of these tags, and the principal purpose of the aperture 227 is to avoid providing too low a value of reluctance for a particular magnetic shunt path between this lamina and a particular component of the make contact lamina 207 yet to be described. The circular portion at the centre of the aperture 227 is smaller in diameter than the central region 221 of the armature (indicated by broken line 229) in order to provide two regions 230 of overlap. The tags 228 are gold plated on both faces like the tags described previously with reference to FIGS. 22, 23, 26 and 27, and the remaining areas of the lamina are covered with adhesive (not shown).

Figure 30:
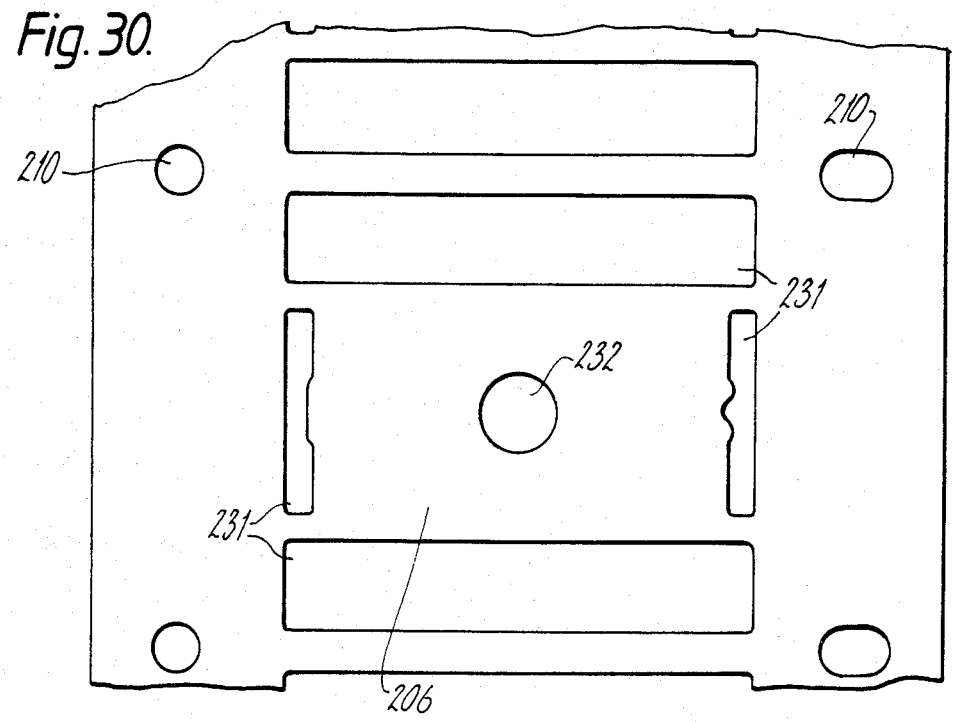
Figure 31:
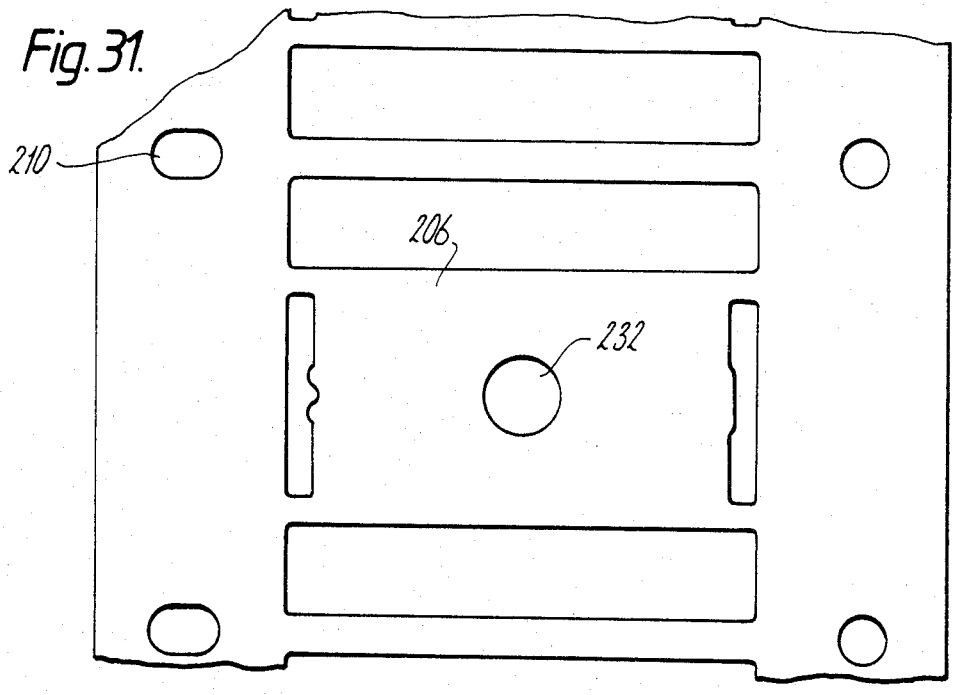

FIGS. 30 and 31 depict respectively the front and rear faces of the tape of spacer laminae 205 which, like spacer laminae 202 and 204 is made of polyimide film. This tape is only about 50 microns thick, and has apertures 231 defining the generally rectangular shape of the lamina and an aperture 232 in centre of the lamina.

Figure 32:
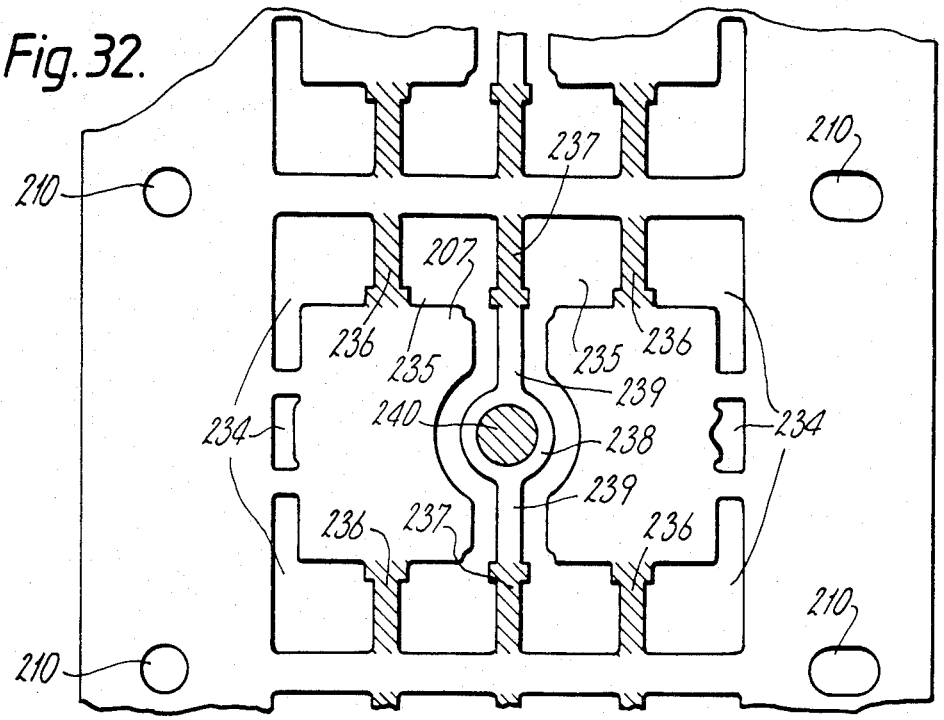
Figure 33:
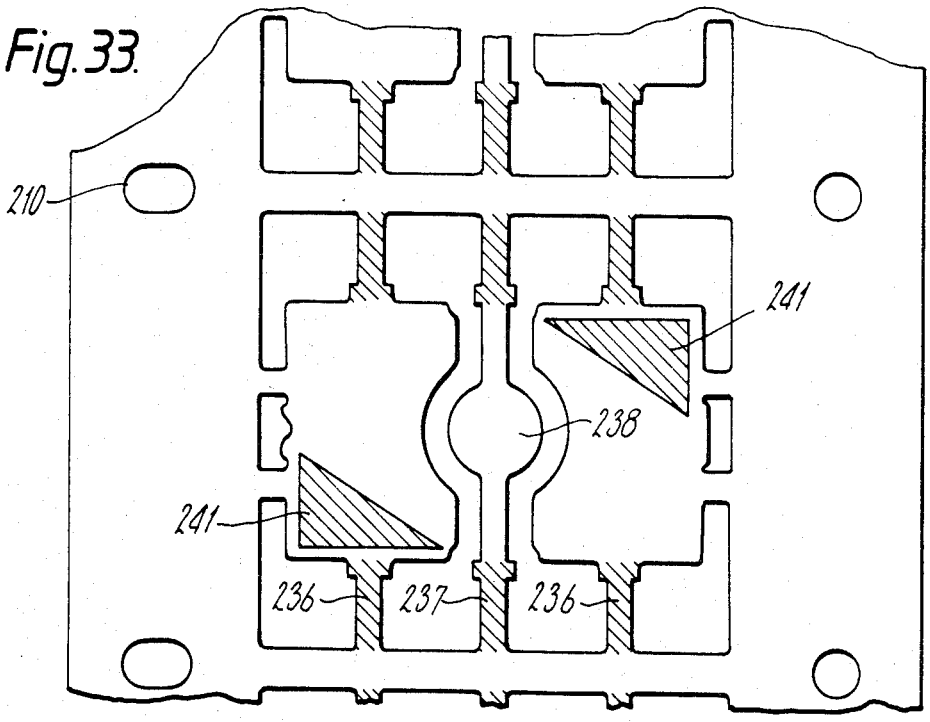

FIGS. 32 and 33 depict respectively the front and rear faces of the tape of make contact laminae 207 made from 0.1 mm thick nickel sheet. Apertures 234 and 235 define the generally rectangular shape of this lamina and its terminal tags 236 and 237. Apertures 235 also serve to separate the central region 238 of the lamina from the two flanking regions, this central region being electrically connected with tags 237 by way of webs 239. On the front face a circular region 240 which is to form the make contact of the relay is made locally thicker, for instance either by electroforming with nickel or by welding on an additional piece of material, so that it stands approximately 0.19 mm proud, and is provided with a precious metal surface coating, for instance of gold, to improve its contact making properties. The terminal tags 236 and 237 are similarly plated with gold on both faces, and gold is also plated on the rear face only in regions 241 to form connection pads to which to solder the ends of an energising coil. Those areas of the front face of the lamina that are neither electroformed nor plated are covered with a layer of adhesive not shown.

The tapes carrying the armature and flux linking laminae 203 and 205 can conveniently be made by photoetching. Those carrying the break and make contact laminae 201 and 207 can also be made in the same way, though, since these laminae may require electroforming, they may alternatively be made by electroforming throughout. The tapes carrying the spacer laminae 202, 204 and 206 are made by blanking.

The tapes carrying the seven lamina 201–7 are assembled in appropriate registry with each other using locating pins (not shown) inserted through the holes 210, and, with the pins in position, the laminae are bonded together in a heated press (not shown). A convenient adhesive, with which to coat the metal laminae for this bonding, is the photoresist film used for masking purposes when they are gold plated or etched.

It is not necessary for all of the laminae of a contact unit to be bonded together in a single operation, indeed there can be advantages in using two or more operations for this purpose. Thus for example it can be advantageous to use a separate operation for bonding the make contact lamina 207 to its adjacent spacer lamina 205 because of the relatively small area of adhesive by which the central region 238 of the make contact lamina and its associated webs 239 is bonded to the spacer lamina 206. If these two lamina are bonded as a separate operation the front face of the spacer lamina 206 can be fully supported over the areas registering with the adhesive on the make contact lamina, whereas if all the laminae are bonded in a single operation it will be noted that the presence of aperture 227 in the pole-piece lamina 205 means that the regions registering with the adhesive on the central region 238 of the make contact lamina and its webs 239 are unsupported.

The remainder of the relay comprises an electromagnetic energising unit consisting of a bobbin 250 carrying a winding 251, and a nickel plated mild steel core and yoke piece-part 252 (FIG. 21). The bobbin and winding are of conventional design, the shape of the core and yoke is illustrated in greater detail in FIGS. 34 and 35 which respectively depict the completed relay and a cross-section of the piece-part 252 along the line X—X in FIG. 34. (In FIG. 34 the terminal tags of the relay are bent over in dual-in-line configuration.) The piece-part 252 has the general shape of a flanged pot-core with cut-away sides. The central boss 253 fits inside the bobbin which is embraced by skirts 254 terminating in flanges 255. Cut-away sides 256 prevent the skirts from overhanging the rest of the relay and allow the ends 257 of the coil 251 to be soldered down to the pads 241 on the make contact lamina. For reasons of magnetic sensitivity it is important to minimise the reluctance between this and the rest of the relay assembly. Direct metal-to-metal contact in the region of the skirt must be prevented so that the yoke does not short the coil. For this reason the piece-part 252 is bonded to the laminar contact unit assembly on the make contact lamina side using two pieces 258 of thin double-sided adhesive tape positioned under the skirts 254 and their flanges 255. The provision of these flanges serves to increase the area and hence reduce the magnetic reluctance presented by the tape. The core area under the central boss 253 is limited, and so, in order to minimise the magnetic reluctance, no tape is used in this region so that the boss can be made slightly longer than the corresponding portions of the skirts to allow still closer approach of the boss to the central region 238 of the make contact lamina 207.

Reverting attention particularly to FIG. 21, when the coil 251 is energised magnetic flux is generated which threads the core 253 and spreads out to enter the laminar contact unit assembly by way of the skirts 254 and flanges 255. The magnetic flux entering the make contact lamina 207 converges towards the central region 238, but is prevented from short circuiting the armature 221 of the diaphragm lamina 203 by virtue of the apertures 235 in the make contact lamina. As a result, most of the flux is caused to enter the outer region of the armature centre 221 by way of the flux linking lamina 205 which allows further convergence of the flux. In the armature 221 itself, the flux converges still further before leaving it to return to the core 253 by way of the make contact 240 and the central region 238 of the make contact lamina.

When the bobbin and winding and the core and yoke piece-part 252 have been secured in position on the assembled contact unit laminae using the adhesive tape 258, the next step is to solder the winding leads 257 to the pads 241 (FIG. 34). Following this, masking tape (not shown) is used to cover both sides of the contact unit tags ready for encapsulating the assembly. Preferably encapsulation is carried out by electrostatic coating with powder, preferably epoxy resin powder, which is subsequently oven cured. Additional protection for the leads 257 may be provided by encasing them in a synthetic rubber coating applied in liquid form and cured prior to the electrostatic powder coating. Next the tape masking the tags is removed, and then a guillotine (not shown) is used to crop the laminae from their tapes. For a dual-in-line version of the relay as illustrated in FIG. 34 all the tags are cropped free at their extremities, and then the tags are all given a right-angle bend near their roots to produce a low profile relay for printed circuit board mounting. For a single-in-line version (not illustrated) the tags on one side are cropped off at their extremities and on the other side are cropped off at their roots to produce a low area relay for printed circuit board mounting.

Functional testing of the encapsulated relay can be performed before it is cropped from all the tapes, and indeed, if thought useful, the finished relay can be delivered to the user on its remaining tapes. These tapes can then prove useful for automatic dispensing of components into printed circuit board assemblies.

It will be readily apparent that the laminar contact unit assembly of this relay can be used in other applications in which the actuating magnetic field is not applied electromagnetically. Thus various forms of mechanically operated switch construction probably employing permanent magnets are possible, of kinds such as those described in U.K. Patent Specification No. 1213699 referred to previously.

I claim:

1. A laminated magnetic field actuated electrical contact unit comprising:

a magnetically responsive armature lamina having a moveable contact portion;

an opposed contact lamina carrying an opposed contact portion cooperating with the moveable contact portion for making and breaking contact therebetween;

and at least one magnetic lamina adjacent at least one of the aforementioned lamina, said magnetic lamina operative to cause relative movement of the moveable contact portion with respect to the opposed contact portion.

2. A contact unit as claimed in claim 1 wherein at least that region of the movable contact portion coming into contact with the co-operating opposed contact portion is plated with precious metal to improve its electrical contact making properties.

3. A contact unit as claimed in claim 1 wherein the armature lamina is conductive and includes a peripheral region, surrounding the moveable contact portion and resilient means including at least two relatively slender arcuate double cantilevers.

4. A contact unit as claimed in claim 1 wherein the magnetic lamina includes first and second ferromagnetic laminae disposed adjacent the armature lamina to direct magnetic flux through the armature from one side to the opposite side, and wherein the relative configurations of said first and second ferromagnetic laminae are such that said magnetic flux passes through the armature from one side at a lower flux density than that with which it passes through the opposite side.

5. A contact unit as claimed in claim 4, wherein at least one of the ferromagnetic laminae acts as a fixed make opposed contact portion, co-operating with the moving contact portion provided by the armature lamina.

6. A contact unit as claimed in claim 1 further including ferromagnetic pole-piece lamina, associated with the armature lamina, whose configuration is such as to direct magnetic flux from itself into the armature lamina and out again from the same side of the armature lamina back into said pole-piece ferromagnetic lamina.

7. A contact unit as claimed in claim 6, wherein the configuration of the ferromagnetic pole-piece lamina that is associated with the armature lamina, is such that the flux passes through the armature lamina in the peripheral region and thence through the central moveable contact region.

8. A contact unit as claimed in claim 7, wherein the pole-piece lamina that is associated with the armature lamina forms a fixed make contact of the opposed contact portion co-operating with the moving contact portion of the armature lamina.

9. A contact unit as claimed in claim 7, wherein the flux passes through the peripheral region of the armature lamina via the pole-piece ferromagnetic lamina and via an intermediate ferromagnetic lamina and wherein the pole-piece lamina is locally thickened to provide a fixed make contact protruding through the thickness of the intermediate lamina.

10. A contact unit as claimed in claim 5, wherein the ferromagnetic lamina that is associated with the armature, and that functions as a make contact is plated with precious metal over at least that region coming into contact with the armature in order to improve its electrical contact making properties.

11. A contact unit as claimed in claim 1, wherein the opposed contact portion is fixed and the moving contact portion co-operates therewith to form a fixed break contact.

12. A contact unit as claimed in claim 1, including an intervening electrically insulating lamina for spacing adjacent electrically conductive laminae, and wherein at least one electrical interconnection between said electrically conductive laminae comprises a soldered connection through an aperture in the intervening electrically insulating lamina.

13. A contact unit as claimed in claim 1 including an intervening electrically insulating lamina for spacing adjacent electrically conductive laminae, and wherein, at least one electrical interconnection between said electrically conductive laminae comprises a plated through hole in the intervening electrically insulating lamina.

14. A contact unit as claimed in claim 1, which is a sealed contact unit.

15. A mechanically operated switch incorporating one or more contact units as claimed in claim 1.

16. An electromagnetic relay incorporating one or more contact units as claimed in claim 1.

17. A relay as claimed in claim 16 further including a permanent magnet operative to magnetically latch the contacts of the relay.

18. A relay as claimed in claim 17 including a ferromagnetic assembly magnetically coupled with the relay contact unit includes the permanent magnet shunted therein, and wherein the construction of the ferromagnetic assembly is such that the value of the magnetic reluctance looking into the assembly from the contact unit is substantially matched with that looking into the contact unit from the assembly.

19. A relay as claimed in claim 16, wherein a relay winding is provided by one or more spiral coils of laminar construction.

20. A relay as claimed in claim 19 wherein a plurality of spiral coils is provided including a flexible printed circuit substrate carrying opposed side adjacent etched spiral conductors, said substrate being folded along lines intermediate each spiral conductor in a fan folded arrangement.

21. A relay as claimed in claim 16 including an excitation coil laminated in operative relation with the moveable contact portion.

22. A laminated magnetic field actuated electric contact unit comprising:

a magnetically responsive electrically conductive armature laminate means, including an insulating support layer and a conductive layer attached thereto, said conductive layer having a moveable contact portion and being axially moveable relative to the support layer, a fixed support portion secured to the support layer and a resilient cantilever means electrically coupling the moving contact portion and the support portion;

contact laminate means axially located adjacent the armature laminate and including an insulating support layer and a contact layer, the contact layer being located in axial relation with the moveable contact portion for making and breaking contact therewith;

a ferromagnetic laminate means for producing a magnetic flux, axially located adjacent at least one of the armature laminate means and the contact laminate means for direction magnetic flux to at least one of the aforementioned laminate means;- variable magnetic means for producing a variable magnetic flux axially located adjacent at least one of the foregoing means for changing the magnetic flux produced by the ferromagnetic means to thereby control movement of the contact portion relative to the contact layer for making and breaking electrical contact therebetween.

23. A contact unit as set forth in claim 22 wherein said variable magnetic means comprises at least one excitable coil.

24. A contact unit as set forth in claim 22 wherein said excitable coil is formed of an etched conductive surface laminated with an insulator.

25. A contact unit as set forth in claim 22 wherein each laminate includes a conductive and non-conductive layer.

26. A contact unit comprising: a structure of laminated operable component layers, including a pair of conductive contact layers, at least one of which is magnetically susceptible and moveable relative to the other for making and breaking electrical contact therebetween;

an insulator laminated between the contact layers for maintaining spaced insulated separation of at least portions thereof;

a ferromagnetic layer for producing a magnetic flux through at least one of said magnetically susceptible contact layers;

a means for changing the flux for effecting relative movement of one contact layer with respect to the other for causing said contact layers to make and break electrical contact therebetween.

27. A contact unit comprising: a structure of laminated operable component layers, including a pair of conductive contacts, at least one of which is magnetically susceptible and moveable relative to the other for making and breaking electrical contact therebetween, said moveable contact including a stationary portion, a moveable portion and integral resilient means connecting the stationary and moveable portions;

an insulator laminated between the contacts for maintaining spaced insulated separation of at least portions thereof;

ferromagnetic means for producing a magnetic flux through at least one of said magnetically susceptible contact layers for effecting relative movement of one contact with respect to the other for causing said contacts to make and break electrical contact therebetween.

* * * * *